United States Patent [19]

Suzuki et al.

[11] 4,153,519

[45] May 8, 1979

[54] SILVER-ELECTROPLATING METHOD USING THIOCYANIC SOLUTION

[75] Inventors: Yoshihiro Suzuki, Hitachi; Tadashi Minakawa, Mito; Osamu Asai, Hitachi, all of Japan

[73] Assignee: Hitachi, Ltd., Tokyo, Japan

[21] Appl. No.: 911,077

[22] Filed: May 31, 1978

Related U.S. Application Data

[63] Continuation-in-part of Ser. No. 765,787, Feb. 4, 1977, abandoned.

[30] Foreign Application Priority Data

Feb. 4, 1976 [JP] Japan ..... 51-10392
Sep. 20, 1976 [JP] Japan ..... 51-111768

[51] Int. Cl.[2] ..... C25D 3/46; C25D 5/10
[52] U.S. Cl. ..... 204/40; 204/46 R
[58] Field of Search ..... 204/46 R, 40

[56] References Cited

U.S. PATENT DOCUMENTS 2,783,194 2/1957 Nobel et al. ..... 204/46 R
3,984,292 10/1976 Culjkovic ..... 204/46 R

OTHER PUBLICATIONS

Domnikov, Metal Finishing (Apr., 1966) vol. 64, No. 4 pp. 57–59.

*Primary Examiner*—Howard S. Williams

[57] ABSTRACT

An electroplating method using an aqueous solution containing thiocyanic ions in an amount of 0.5 to 10 moles/l, silver ions in an amount of 0.04 to 0.8 mole/l and a film improving agent in an amount effective to suppress a local growth of a silver film on a metallic substrate to be plated, which comprises subjecting, prior to the electroplating, the metallic substrate to a preplating step under a current density of 0.1 to 80 mA/dm$^2$ in an aqueous solution containing silver ions in an amount of 0.001 to 0.02 mole/l and thiocyanic ions in an amount of 0.1 to 5 moles/l whereby the adhesiveness of the resulting electroplated silver film to the substrate is improved.

11 Claims, 3 Drawing Figures

SILVER-ELECTROPLATING METHOD USING THIOCYANIC SOLUTION

CROSS REFERENCE TO THE RELATED APPLICATION

This is a continuation-in-Part of U.S. Ser. No. 765,787, filed Feb. 4, 1977, now abandoned.

The present invention relates to a method of silver electroplating and more particularly to a method of electroplating comprising an electropreplating step and an electroplating step in thiocyanic-silver ions solutions.

Almost all of the silver plating solutions so far in practice containing cyan ions, that is, the solutions containing the so-called cyanides as the main component. Plating films having very good elongation and luster can be formed from such plating solutions. However, as is well known, the cyan ions have a strong toxicity, and thus such plating solutions have many problems in maintenance of safe working atmosphere, treatment of waste effluent solution, etc. Thus, development of a silver plating solution containing no cyan ions has been keenly desired up to now.

Typical silver plating solutions containing no cyan ions include a silver nitrate bath [F.C. Mathers, J.R. Kuebler: Trans. Amer. Electro. Soc., 29, 417 (1916)], silver sulfamate bath [R. Pionteppi: Korr. u. Metalschutj. 19, 110 (1943)], a silver chloride bath [A.K. Graham, S. Heiman, H. L. Pinkerton: Plating, 36, 47 (1949)], and a bath containing thiocyanate ions [L. Domnikov: Metal Finishing, 64, [4], 57 (1966)].

These baths have been carefully tested and compared, and it has been found that all the plating films obtained from these baths have considerably poorer properties than those of the plating films obtained from the bath containing cyan ions. That is, the former plating films have such disadvantages as poor luster, fragile plating films, or dendritic or rugged surfaces, lacking in smoothness, etc., and thus have not been utilized on an industrial scale. Furthermore, when a metallic substrate is other than silver, there is such a common disadvantage that an adhesiveness between the substrate and the plated film is poor.

An object of the present invention is to improve the adhesiveness of an electroplated silver film to a metallic substrate as well as to improve the quality of the electroplated film.

Another object of the present invention is to provide a method of silver electro-plating which is capable of forming an electroplated silver film having a high toughness, an excellent appearance and good throwing power.

Still another object of the present invention is to provide a method of silver electroplating using an aqueous solution containing non-toxic ingredients.

According to the present invention, there is provided an electroplating method comprising a step of electropreplating a metallic substrate in an aqueous solution containing silver ions in an amount of 0.001 to 0.02 mole/l and thiocyanic ions in an amount of 0.1 to 5 moles/l under a cathode current density of 0.1 to 80 $mA/dm^2$ and a step of electroplating the preplated substrate in an aqueous solution containing thiocyanic ions in an amount of 0.5 to 10 moles/l, silver ions in an amount of 0.04 to 0.8 mole/l and a film improving agent in an amount sufficient to suppress a local growth of silver deposition under a cathode current density of 0.5 to $10A/dm^2$.

The present invention is featured at first by employing an electropreplating a metallic substrate in an aqueous solution containing a very small amount of silver ions under a very small current. Secondly, the present invention is featured by employing electroplating the preplated substrate in an aqueous solution containing silver ions, thiocyanic ions and a film improving agent whereby an electroplated silver film having a good adhesiveness to the substrate and good film quality is obtained.

The present invention is applied to silver plating of metallic substrates such as copper, silver, gold, metals of platinum group, or their alloys. Substrates may be composite material or laminates comprising a metallic film and an insulating body.

When the metallic substrate is a pure noble metal, a good adhesion is obtained between the substrate and the resulting plating film, but in other cases the adhesiveness is sometimes poor. When a thick silver plating film if formed, the resulting plating film is sometimes peeled off during the plating, if the adhesiveness is poor. As a means for enhancing the adhesiveness, a preplating is applied in the present process. When a more readily ionizable metal than silver is placed in the present silver plating solution, the metal is dissolved into the silver plating solution, while silver is deposited instead. That is, the so-called substitution plating takes place. The silver plating film formed by the substitution plating has a low mechanical strength. To prevent the substitution plating, the preplating is carried out in the present invention.

In the present invention, the preplating is carried out in a solution having the low concentration of silver ions at an extremely low cathode current density to deposit a thin silver film. The conventional strike plating is carried out at a high current density, whereas the present process is carried out characteristically at a low current density. The plating solution for the preplating has a silver ion concentration of 0.001 to 0.02 mole/l and contains a large amount of silver complexing agent. Typical composition of plating solution for the preplating is 0.001 to 0.02 mole/l of silver and 0.1 to 5 moles/l of thiocyanic ion, and the film-improving agent may be contained in the solution for the preplating. The preplating is carried out at a cathode current density of 0.1 to 80 $mA/dm^2$, preferably 5 to 50 $mA/dm^2$ at room temperature for a period of about 10 seconds to about 10 minutes. The plating film to be formed by the preplating must have a thickness large enough to substantially prevent any occurrence of the substitution plating, that is, usually a thickness of at least several hundred Å.

After the preplating step, mentioned above, an electroplating of the metallic substrate is carried out in an aqueous solution containing silver ions of 0.04 to 0.8 mole/l, thiocyanic ions of 0.5 to 10 moles/l and a film improving agent.

When said film-improving agent is added to the plating solution containing thiocyanic ions and silver ions, a stable complex of silver ions or sparingly soluble silver compounds are formed in the plating solution. Thus, silver deposition overvoltage is increased, as the complex ions or the sparingly soluble silver compounds are absorbed selectively at the active locations on a cathode, and consequently silver deposition on its locations are suppressed. That is, it seems that flatness of the plating film is ensured thereby, and consequently luster and mechanical properties of the plating film are improved.

In carrying out the present invention, practical composition of the silver plating solution is in the following range:

Silver ions ($Ag^{30}$): 0.04 to 0.08 mole/l

Thiocyanic ions ($SCN^{31}$): 0.5 to 10 moles/l

Silver ions are generated from dissolved silver compounds such as AgCl, AgBr, AgI, AgSCN, $Ag_2O$, $Ag_2CO_3$, $Ag_2SO_4$, $AgNO_3$, $Ag_2SeO_4$ or $AgCH_3COO$. Thiocyanic ions are obtained by dissolving thiocyanic compounds such as KSCN, NaSCN, $NH_4SCN$, CsSCN, or RbSCN. When AgSCN is used as a source of silver ions, a concentration of thiocyanic ions is determined by taking into consideration a concentration of AgSCN.

As the film-improving agent the following ions or compounds are preferably used.

| | |
|---|---|
| Bromine ions ($Br^-$) | $1 \times 10^{-3}$ to $1 \times 10^{-1}$ mole/l |
| Iodine ions ($I^{31}$) | $1.2 \times 10^{-4}$ to $1.2 \times 10^{-3}$ mole/l |
| Selenocyanic ions ($SeCN^-$) | $5 \times 10^{-4}$ to $1 \times 10^{-2}$ mole/l |
| Selenic acid ions ($SeO_4^{--}$) | $5 \times 10^{-6}$ to $5 \times 10^{-3}$ mole/l |
| Cobalt ions ($Co^{++}$) | " |
| Stannic acid ions ($SnO_3^{--}$) | $1 \times 10^{-4}$ to $1 \times 10^{-2}$ mole/l |
| Thiourea ($SC(NH_2)_2$) | $5 \times 10^{-6}$ to $5 \times 10^{-3}$ mole/l |
| Triethanol amine ($(HOCH_2CH_2)_3N$) | $1 \times 10^{-3}$ to 1 mole/l |

Film improving ions or compounds are obtained by dissolving in an electroplating solution KSeCN, NaSeCN, KBr, NaBr, KI, NaI, AgI, RbI, CsI, $H_2SeO_4$, $Ag_2SeO_4$, $K_2SeO_4$, $Na_2SeO_4$, $CoSeO_4$, $CoSO_4$, $CoCl_2$, $CoSeO_4$, $Na_2SnO_3$, $SC(NH_2)_2$, or $(HOCH_2CH_2)_3N$. The film improving agents are used singly or in combination.

When such compounds as AgI or $Ag_2SeO_4$ are used, the concentration of silver ions in the electroplating solution is determined by taking into consideration the amount of a film improving agent used. When such compounds as $CoSeO_4$ is used, both $Co^{++}$ and $SeO_4^{--}$ function as film improving agents or ions in the solution.

The ranges for the film improving agents as described above have been determined by experiments, and if the amount of the film-improving agents is less than the lower limits of the ranges, the resulting silver plating films have a poor luster and unsatisfactory mechanical properties. When the amount exceeds the upper limits of the ranges, the grains in the plating films become coarse, and the plating films become brittle.

The improvement of the toughness of the silver plating films is most remarkable when iodine ions is added to the solution, and is decreased in the order of selenocyanic ions to bromine ions, but the differences in the improvement among these agents are not so large. However, the improvement of the throwing power is far greater when selenocyanic ions is added to the solution than when other two agents each are added thereto. Therefore, an addition of a mixture of bromine or iodine ions with selenocyanic acid to the solution can greatly improve both the properties of the resulting silver plating films and the throwing power.

Besides said film-improving agents, ammonia has a capacity to form complex compounds of silver, and thus it is preferable to use ammonia to control pH of the present plating solution or add ammonium thiocyanate as an electrolyte in place of alkali thiocyanate. Especially, a silver plating film having a good luster can be obtained from the present plating solution having a pH elevated by the addition of ammonia.

When effective additives for silver cyanide plating solutions, such as urea, alcohol, gelatin or amines, for example, ethylenediamine tetraacetic acid, are added to the present plating solution, similar effects can be obtained. In the addition of these additives, it is necessary to determine relations between the amounts of the additives and other effects by carrying out tests in advance, for the effects of the addition sometimes depend upon the kind of plating solution, plating conditions, and further upon the mind of researchers.

The pH range of the plating solution to be used in the present invention is 0.5 to 10.5, which is very broader than the pH range of more than 10 in the conventional silver cyanide bath. When the plating solution is in an acidic zone of less than pH 0.5, the luster of the resulting plating film is deteriorated, losing the effect of the addition of the film-improving agent. On the other hand, when pH is higher than 10.5, black silver compounds are suspended in the plating solution, and tone of the resulting plating film becomes blackish. However, if the plating is carried out only for a short time even at pH of about 11, none of such states appears that the plating solution is deteriorated and no more silver plating film is formed. The optimum pH range for the present plating solution is 3 to 9. When ammonia is contained in the present plating solution, a preferable condition is obtained for forming the plating film at pH of 8 to 11, as described earlier.

The broadness of the allowable pH range for the plating solution offers not only such an advantage that the bath can be easily controlled, but also such another advantage that impurities contaminating the plating solution can be precipitated by adjusting pH to the desired value, and removed by filtration, and the resulting filtrate can be used immediately as the plating solution. Furthermore, there is a solder layer or an insulating material, as attached to a material to be plated, and if the solder layer or the insulating material is readily attacked by the plating solution, such a pH range as to sparingly attack the solder layer or the insulating material can be selected to carry out the plating. This is other advantage of the present plating solution.

As materials to be plated, nickel, copper, silver, gold, metals of platinum group, and their alloys can be used. Surfaces of these substrate metals are thoroughly cleaned in the manner as usually practised by those skilled in the art, and then the plating is carried out by connecting the cleaned substrate metals to a cathode.

Plating is carried out by stirring the plating solution or keeping the plating solution in a flowing state at a cathode current density of 0.5 to 10 $A/dm^2$ and a bath temperature of room temperature to 50° C., using silver as an anode. Electric source may be a DC current or AC current-superposed DC current. Of course, either a constant voltage source or a constant current source can be used.

Besides the plating in the ordinary plating tank, the so-called local plating method can be carried out by making the plating solution flow along parts of the material to be plated or providing the plating solution soaked in a sponge or the like on the parts of the material to be plated, and plating films can be thereby formed, because the present plating solution is hardly toxic.

The present invention will be described in detail by referring to Examples and the accompanying drawings.

Procedures for determining various properties of plating films shown in Examples are described below.

Tensile strength and elongation: Resulting silver plating film is peeled off from a substrate metal, and a rectangular test piece having an available tension part of 8 mm wide and 40 mm long is prepared therefrom, and measured by an Universal micro-tension tester made by Toyo Sokki K.K., Japan. Values given therein are an average of five measurements.

Luster: A luster is visually observed or a white light beam is irradiated onto a plating film, the light reflected on the plating film is received in a photo-electric tube, and a luster is determined from relations between an angle of light source-plating film-light receiver (scattered angle: $\theta$) and an intensity of reflected light.

Figure 1:
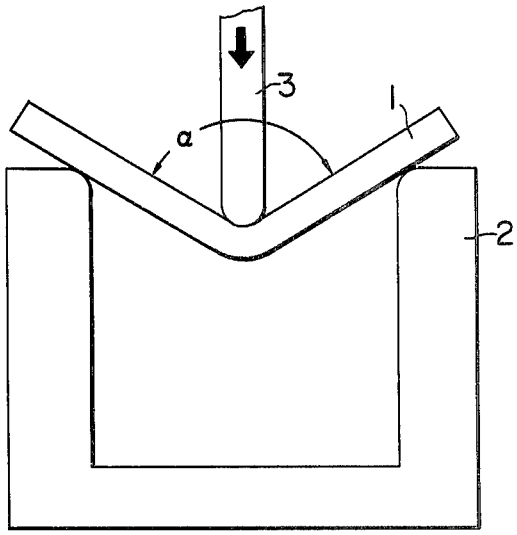
FIG. 1 is a schematic view of a bending test to evaluate an adhesiveness of electroplated silver film.

Adhesiveness: A silver plating film having a thickness of 12 $\mu$m is formed on a copper plate having a thickness of 6 mm, a width of 12 mm, and a length of 100 mm, and the resulting plate is used as a test piece. The side of the plated plate to be tested is placed on two fulcra having a distance of 60 mm, and a bar having a radius of curvature of 3.5 R at its tip is pressed against the back side of the plated plate at a center between the fulcra. State of crack development and state of peeling of the plating film on the plated side are observed. Pressing speed is 5 mm/min. Adhesiveness is classified into 5 grades, whose standards are given in Table 1. The outline of testing apparatus is shown in FIG. 1, wherein numeral 1 is a test piece, 2 fulcra, and 3 a pressing plate.

Thickness of plating film: measured according to procedure for electrolyte measurement of thickness (JIS H 8618) and microscopic measurement of cross-section.

Appearance: White light is irradiated onto the plating film, and the film is visually observed.

Table 1

| Grade of adhesiveness | State of plating film |
|---|---|
| 1 | No cracks are developed. |
| 2 | Slight cracks are developed at edge parts. |
| 3 | Small cracks are developed at both edge parts and center part. |
| 4 | Large cracks are developed at both edge parts and center part. |
| 5 | Plating film is peeled off. |

Throwing power: A copper disk having a diameter of 50 mm is placed in parallel with an anode, and section thicknesses of silver plating film at center part a and location b 5 mm distant from circumference at the back side of the disk, that is, the side not facing the anode, are microscopically measured, and a throwing power is evaluated by a ratio of film thickness of b/a.

Overall judgement: Overall judgement is made in view of plating workability and properties of the resulting film. Standards for the judgement are given in Table 2.

Table 2

| Overall judgement | Mode |
|---|---|
| A | Very good |
| B | Good |
| C | Poor |
| D | Very poor |

In the following Examples, 1 to 4 are concerned with effects of film improving agents. The electroplating in the examples were carried out without preplating. By combining the preplating and the plating steps, it is possible to obtain excellent silver films.

0 to 0.5 moles/l of silver bromide were added to aqueous solutions, each, containing 0.1 mole/l of silver thiocyanate and 3 moles/l of potassium thiocyanate, and pH of the solutions were adjusted to ranges of 6.5 to 7, using a dilute aqueous solution of potassium hydroxide and a dilute aqueous solution of sulfuric acid.

3 l of the pH-adjusted plating solutions were placed in respective thermostat plating tanks, and samples were plated, using silver plate as anode at an interelectrode distance of 100 mm and a plating bath temperature of 30°±2° C., while blowing air into the tanks at a rate of 3 l/min for stirring the plating solutions.

The samples were stainless steel plates having a size of 50 mm×60 mm, whose one side was copper plated to a thickness of 0.5 $\mu$m with a copper pyrophosphate plating solution, and whose other side was completely coated with an epoxy resin film.

The samples were connected to a cathode of a DC constant current power source, and the plating was carried out for 10 minutes at a cathode current density of 1.7 A/dm$^2$. The theoretical plating thickness calculated from the quantity of electricity was then 10.8 $\mu$m.

Figure 2:
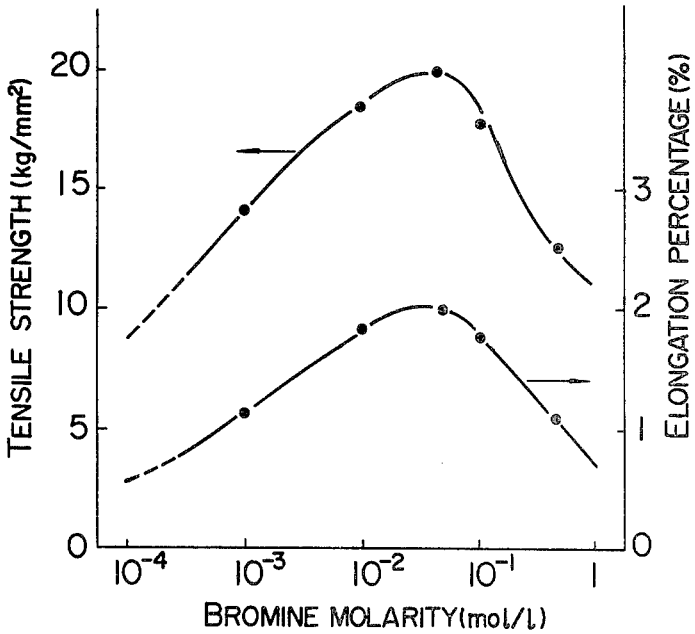
FIG. 2 is a diagram showing relations of bromine ions molarity to tensile strength and elongation percentage of silver plating films.

Appearance, plating film thickness, tensile strength and elongation of the resulting silver plating films were measured, and overall judgements as the plating solution were made. The results are shown in Table 3 and FIG. 2.

Table 3

| No. | Concentration of film-improving agent (AgBr) (mole/l) | Tensile strength (kg/mm$^2$) | Elongation (%) | Film thickness ($\mu$m) | Appearance | Overall judgement |
|---|---|---|---|---|---|---|
| Comparative 1 | 0 | — | — | about 10 | Milk white, lusterless | D |
| Comparative 2 | $1 \times 10^{-4}$ | about 8 | about 0.5 | 10.2 | Milk white, lusterless | D |
| 1 | $1 \times 10^{-3}$ | 14 | 1.1 | 10.5 | Silver white, partly lustrous, partly turbid | B |
| 2 | $1 \times 10^{-2}$ | 18 | 1.8 | 10.5 | Silver white, lustrous | A |
| 3 | $4 \times 10^{-2}$ | 20 | 2 | 10.1 | Silver white, | A |

Table 3-continued

| No. | Concentration of film-improving agent (AgBr) (mole/l) | Tensile strength (kg/mm$^2$) | Elongation (%) | Film thickness (μm) | Appearance | Overall judgement |
|---|---|---|---|---|---|---|
| | | | | | lustrous | |
| 4 | $1 \times 10^{-1}$ | 17.6 | 1.7 | 10.3 | Silver white, lustrous | A |
| Comparative 3 | $5 \times 10^{-1}$ | 12 | 1.1 | 10.7 | Silver white, partly lustrous, uneven in surface | C |

From the plating solution containing no AgBr as the film-forming agent was deposited a milk white, brittle plating film, on whose surface cracks were developed when a thin piece for tensile test was prepared, and its tensile strength could not be measured. At the AgBr concentration of about $2\times10^{-2}$ mole/l, the plating films had a maximum tensile strength and maximum elongation. The tensile strength and elongation were lowered again at the AgBr concentration of about $10^{-1}$ mole/l. The tensile strength and elongation at the AgBr concentration of $5\times10^{-1}$ mole/l were almost identical with those at the AgBr concentration of $10^{-3}$ mole/l, but the resulting plate film readily had an uneven surface, and the plating solution was overall-judged as C.

Figure 3:
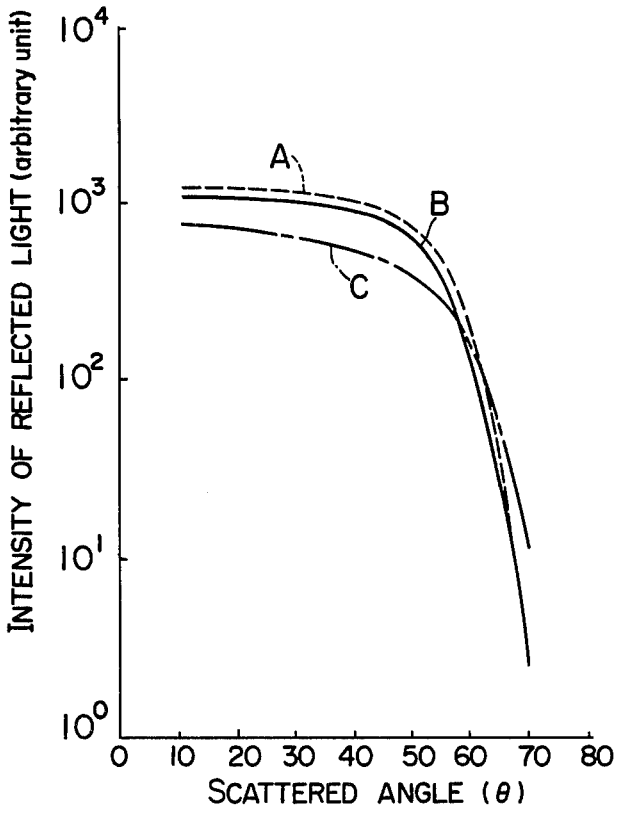
FIG. 3 is a diagram showing relations between an intensity of reflected light and scattered angle of silver plating film, using white light.

Intensities of reflected light from test piece No. 3 and test piece No. Comparative 1 were measured. Relations between the intensities of reflected light and scattered angle are shown in FIG. 3 where A relates to the present invention (test piece No. 3), and C relates to the test piece No. Comparative 1 containing no film-improving agent.

For comparison, another silver plating film was formed from a standard plating solution of silver cyanide system so far widely used, and its properties were measured. Tensile strength was 18 to 22 kg/mm$^2$, elongation 2%, and appearance was silver white and lustrous. Its overall judgement was marked "A." That is, the conventional plating film had similar properties to those of the present invention. Its intensity of reflected light is given as B in FIG. 3.

Example 2

Test results based on iodine as the film-improving agent are given in Table 4, where compositions of the plating solutions used, properties of the resulting silver plating films and overall judgements as the plating solution are shown.

Table 4

| NO. | Composition of plating solution (mole/l) | | pH | Tensile strength (kg/mm$^2$) | Elongation (%) | Appearance | Overall judgement |
|---|---|---|---|---|---|---|---|
| Comparative 4 | AgSCN 0.5-KSCN 3-AgI | 0 | 6.5 | — | — | Milk white, lusterless, uneven in surface | D |
| Comparative 5 | " | $5 \times 10^{-5}$ | " | — | — | Milk white, lusterless | D |
| 5 | " | $2 \times 10^{-4}$ | " | 21 | 2.2 | Silver white, lustrous | A |
| 6 | " | $8 \times 10^{-4}$ | " | 22 | 2.4 | Silver white, lustrous | A |
| 7 | " | $1.2 \times 10^{-3}$ | " | 21 | 2.2 | Silver white, lustrous, somewhat uneven in surface | B |
| Comparative 6 | " | $2 \times 10^{-3}$ | " | 20 | 1.9 | Silver white, lustrous, uneven in surface | C |
| Comparative 7 | AgSCN 0.3-$NH_4SCN$ 4-KI | 0 | " | — | — | Milk white, lustreless | D |
| 8 | " | $3 \times 10^{-4}$ | " | 18 | 1.7 | Silver white, lustrous, even in surface | A |
| 9 | AgSCN 0.3-$NH_4SCN$ 4-KI | $1 \times 10^{-3}$ | " | 22 | 2.3 | lustrous, even in surface | A |
| Comparative 8 | AgSCN 0.2-KSCN 2-RbI | $4 \times 10^{-4}$ | 0.3 | 13 | 0.8 | Silver white, somewhat poor in luster | C |
| 10 | " | " | 1 | 19 | 1.9 | Silver white, lustrous | A |
| 11 | " | " | 4 | 19 | 1.9 | Silver white, lustrous | A |
| 12 | " | " | 8 | 21 | 1.8 | Silver white, lustrous | A |
| 13 | " | " | 10 | 21 | 2.0 | Silver white, lustrous, somewhat uneven in surface | B |
| Comparative 9 | " | " | 11.5 | 16 | 1.3 | Blackish, lustrous, uneven in periphery | C |
| 14 | AgSCN 0.06-$NH_4SCN$ 4-CsI | $5 \times 10^{-4}$ | 6.5 | 17 | 1.8 | Silver white, lustrous | A |
| 15 | " | $1 \times 10^{-3}$ | " | 18 | 1.9 | Silver white, | A |

Table 4-continued

| NO. | Composition of plating solution (mole/l) | pH | Tensile strength (kg/mm²) | Elongation (%) | Appearance | Overall judgement |
|---|---|---|---|---|---|---|
| | | | | | lustrous | |

Similar effects of improvement were obtained with potassium iodide, rubdinum iodide and cesium iodide as the film-improving agents to be added, in place of silver iodide.

EXAMPLE 3

Results of tests using silver selenocyanate as the film-improving agent are given in Table 5, where $1\times10^{-5}$ to $1\times10^{-1}$ mole/l of silver selenocyanate were added to plating solutions, each, containing 0.2 moles/l of silver thiocyanate and 3 moles/l of potassium thiocyanate, and silver plating films were formed in the same manner as in Example 1.

Table 5

| No. | Concentration of AgSeCN as film-improving agent (mole/l) | Tensile strength (kg/mm²) | Elongation (%) | Appearance | Overall judgement |
|---|---|---|---|---|---|
| Comparative 10 | $1\times10^{-5}$ | — | — | Milk white, lusterless | D |
| 16 | $5\times10^{-4}$ | 16.7 | 1.8 | Silver white, lustrous, somewhat uneven in surface | B |
| 17 | $1\times10^{-3}$ | 18.0 | 2.1 | Silver white, lustrous | A |
| 18 | $1\times10^{-2}$ | 17.0 | 1.9 | Silver white, lustrous | A |
| Comparative 11 | $1\times10^{-1}$ | 14.8 | 1.6 | Silver white, lustrous, uneven in surface | C |

EXAMPLE 4

Plating solutions were prepared by adding potassium bromide, potassium iodide, potassium selenocyanate and a mixture of potassium iodide and potassium selenocyanate to plating solutions, each, containing 0.2 mole/l of silver thiocyanate and 3 moles/l of potassium thiocyanate.

One side each of copper disks having a diameter of 50 mm was coated with a paint of rubber system, and the exposed side of copper disks was plated for 30 minutes in the respective plating solutions, by placing the exposed side, that is, the side to be deposited, of the copper disk away from an anode, that is, by making the coated side face the anode. Thicknesses of the resulting plating film were measured at the center part a of the disks and at the position b 5 mm distant from the periphery to indicate the throwing power in terms of b/a. The results are given in Table 6.

Table 6

| No. | Concentration of film-improving agent (mole/l) | Throwing power (b/a) | Appearance | Overall judgement |
|---|---|---|---|---|
| 19 | KBr $5\times10^{-2}$ | 1.5 | Round projections developed at periphery | B |
| 20 | KI $5\times10^{-4}$ | 1.5 | Round projections developed at periphery | B |
| 21 | KSeCN $5\times10^{-3}$ | 1.3–1.4 | Smooth projections developed at periphery | A |
| 22 | KI $5\times10^{-4}$ – KSeCN $5\times10^{-3}$ | 1.2 | Smooth | A |

Addition of the mixture of iodide and selenocyanate has a great effect of improving the throwing power.

EXAMPLE 5

Effect of preplating upon adhesiveness is shown in the instant Example.

Surfaces of copper plates having a thickness of 6 mm, width of 12 mm and length of 100 mm were polished to smooth by Emery abrasive paper and buffing, then defatted in acetone, and washed with water, and then the copper plates were subjected to preplating. The, silver plating films were formed to a thickness of 12 μm, using plating solutions containing 0.2 mole/l of silver thiocyanate, 3 moles/l of potassium thiocyanate, and film-improving agent. The resulting plating films were deformed on a bending testing machine shown in FIG. 1, and the adhesiveness of the films was evaluated in view of the states of crack development on the plating films. The bending angles of less than 60° were obtained by forcedly bending the plate outside the testing machine. Conditions for preplating, film-improving agents used in the silver plating, and results of the bending tests are given in Table 7.

Table 7

| No. | Preplating solution (mole/l) AgSCN | KSCN | Br⁻, I⁻, or SeCN⁻ | Current density (mA/dm²) | Time (min.) | Silver plating film-improving agent (mole/l) | Bending test (α) 135° | 90° | 45° | 20° |
|---|---|---|---|---|---|---|---|---|---|---|
| Comparative | | | 0 | | | | | | | |
| 12 | $6\times10^{-4}$ | 0.8 | 0 | 10 | 5 | $Br^-$ $1\times10^{-2}$ | 1 | 3 | 4 | 4 |
| 23 | $1\times10^{-3}$ | " | 0 | " | " | " | 1 | 1 | 1 | 1 |
| 24 | $1\times10^{-3}$ | " | 0 | " | 3 | " | 1 | 1 | 1 | 2 |
| 25 | $1\times10^{-2}$ | " | 0 | " | 5 | " | 1 | 1 | 1 | 2 |
| Comparative | | | | | | | | | | |

Table 7-continued

| No. | Preplating solution (mole/l) AgSCN | KSCN | $Br^-$, $I^-$, or $SeCN^-$ | Current density ($mA/dm^2$) | Time (min.) | Silver plating film-improving agent (mole/l) | Bending test (α) 135° | 90° | 45° | 20° |
|---|---|---|---|---|---|---|---|---|---|---|
| 13 | $5 \times 10^{-2}$ | " | 0 | " | " | " | 1 | 1 | 2 | 2 |
| Comparative 14 | — | — | — | — | — | " | 2 | 3 | 5 | 5 |
| 26 | $1 \times 10^{-3}$ | 0.1 | $Br^- 1 \times 10^{-2}$ | 10 | 5 | " | 1 | 1 | 2 | 2 |
| 27 | " | 1 | " | " | 3 | " | 1 | 1 | 1 | 2 |
| 28 | " | 4 | " | " | 3 | " | 1 | 2 | 2 | 3 |
| 29 | $1 \times 10^{-3}$ | 1.5 | $I^- 2 \times 10^{-4}$ | 0.1 | 5 | $I^- 2 \times 10^{-4}$ | 1 | 1 | 2 | 3 |
| 30 | " | " | " | 5 | " | " | 1 | 1 | 1 | 2 |
| 31 | " | " | " | 30 | " | " | 1 | 1 | 1 | 2 |
| 32 | " | " | " | 50 | 5 | " | 1 | 1 | 1 | 2 |
| Comparative 15 | $1 \times 10^{-3}$ | 1.5 | $I^- 2 \times 10^{-4}$ | 100 | 5 | $I^- 2 \times 10^{-4}$ | 1 | 2 | 3 | 3 |
| 33 | $1 \times 10^{-3}$ | 1.5 | 0 | 20 | 5 | $SeCN^- 5 \times 10^{-4}$ | 1 | 1 | 2 | 2 |
| 34 | " | " | $SeCN^- 5 \times 10^{-4}$ | " | " | " | 1 | 1 | 1 | 2 |
| Comparative 16 | $1 \times 10^{-3}$ | 1.5 | $SeCN^- 5 \times 10^{-4}$ | " | " | 0 | 4 | 5 | 5 | 5 |

As is apparent from the results shown in Table 7, the preplating solutions contain 0.001 to 0.02 moles/l of silver thiocyanate and 0.1 to 4 moles/l of thiocyanic ion as essential components, and the plates were treated in the preplating solutions at a cathode current density of 0.1 to 80 $mA/dm^2$, preferably 5 to 50 $mA/dm^2$. Test piece No. Comparative 14 was the one directly subjected to the silver plating without any preplating, and small cracks developed at edges and center part at the bending angle of 90°.

Test piece No. Comparative 16 was the one obtained by preplating and successive silver plating without using the film-improving agent, and the silver plating film was peeled off at the bending angle of 90°.

When a silver plating film obtained from the conventional silver cyanide solution was subjected to the same bending test as above, the grades judged were 1 to 2 when bent to 20°. Thus, the adhesiveness was almost equal to that of the plating film obtained according to the present invention.

EXAMPLE 6

As film improving agents selenoic acid, thiourea, cobalt sulfate, and cobalt selenoate were added to silver-thiocyanic ions solutions. Concentrations of the ingredients are shown in Table 8. For comparison, nickel sulfate was added as a film improving agent. Substrates were preplated in the same manner used in Example 5, prior to silver electroplating.

Table 8

| No. | Plating solution $Ag^+$ (mole/l) | $SCN^-$ (mole/l) | Film Improving Agent (mole/l) | |
|---|---|---|---|---|
| Comparative 17 | 0.3 | 3.0 | $H_2SeO_4$ | $1 \times 10^{-6}$ |
| 35 | " | " | " | $1 \times 10^{-4}$ |
| Comparative 18 | " | " | " | $1 \times 10^{2}$ |
| " 19 | 0.1 | 2.0 | $SC(NH_2)_2$ | $1 \times 10^{-6}$ |
| 36 | " | " | " | $1 \times 10^{-5}$ |
| 37 | " | " | " | $1 \times 10^{-3}$ |
| Comparative 20 | " | " | " | $1 \times 10^{-2}$ |
| " 21 | 0.3 | 3.5 | $CoSO_4$ | $1 \times 10^{-6}$ |
| 38 | " | " | " | $1 \times 10^{-4}$ |
| Comparative 22 | " | " | " | $1 \times 10^{-2}$ |
| " 23 | 0.4 | " | $CoSeO_4$ | $1 \times 10^{-6}$ |
| 39 | " | " | " | $1 \times 10^{-4}$ |
| Comparative 24 | " | " | " | $1 \times 10^{-2}$ |
| " 25 | 0.3 | 2.0 | $NiSO_4$ | $1 \times 10^{-4}$ |
| " 26 | " | " | " | $1 \times 10^{-3}$ |

Properties of the resulting electro-plated silver films are shown in Table 9 below.

Table 9

| No. | Tensile strength ($kg/mm^2$) | Elongation (%) | Throwing power (%) | Overall judgement |
|---|---|---|---|---|
| Comparative 17 | 15.0 | 1.3 | 35.0 | D |
| 35 | 20.2 | 1.9 | 43.3 | B |
| Comparative 18 | 18.3 | 1.7 | 38.2 | C |
| " 19 | 13.8 | 1.4 | 35.3 | D |
| 36 | 19.4 | 1.8 | 37.1 | B |
| 37 | 19.7 | 1.9 | 38.3 | B |
| Comparative 20 | 17.3 | 1.7 | 39.7 | C |
| " 21 | 14.5 | 1.5 | 33.0 | C |
| 38 | 21.1 | 2.0 | 43.8 | A |
| Comparative 22 | 18.8 | 1.7 | 41.0 | C |
| " 23 | 14.8 | 1.4 | 33.2 | D |
| 39 | 19.1 | 1.9 | 38.7 | B |
| Comparative 24 | 17.6 | 1.7 | 37.5 | C |
| " 25 | 18.7 | 1.8 | 38.1 | E |
| " 26 | 18.9 | 1..7 | 37.9 | E |

EXAMPLE 7

KSCN was dissolved in water in an amount of 3 moles/l.

$AgNO_3$ was added in the solution in amounts of 0.01, 0.05, 0.08, 0.3 and 1.5 moles/l. KI was added to the solution in an amount of 0.0005 mole/l.

3 Liters of the resulting solution was charged in a plating bath.

Substrates used in the experiments were stainless steel plates with a copper plating of 5 μm thickness. After the preplating mentioned in Example 5, silver plating was carried out in the following conditions.

| | |
|---|---|
| Electrode distance: | 100 mm |
| Anode: | silver plate |
| Cathode: | copper plated substrate (50 mm × 60 mm) |
| Solution temperature: | 30 ± 2° C. |
| Agitation of solution: | air with a rate of 3 l/min |
| Cathode current density: | 1.7 $A/dm^2$ |
| Plating time: | 10 min |
| Post treating: | after electroplating, the resulting silver plating was immersed in a KSCN solution of 1 mole/l and then washed with water |

Properties of silver platings are shown in Table 10 below.

Table 10

| No. | $AgNO_3$ (mole/l) | Tensile strength (kg/mm$^2$) | Elongation (%) | Throwing power (%) | Overall judgement |
|---|---|---|---|---|---|
| 1 | 0.01 | — | — | — | E |
| 2 | 0.05 | 18.0 | 1.7 | 37 | B |
| 3 | 0.08 | 19.1 | 1.8 | 38 | R |
| 4 | 0.3 | 20.3 | 2.0 | 40 | A |
| 5* | 0.8 | 20.0 | 1.9 | 41 | A |
| 6 | 1.5 | 18.0 | 1.8 | 40 | C |

*Concentration of iodine ions was 0.001 mole/l

EXAMPLE 8

$Ag_2SO_4$, $Ag_2O$, $Ag_2CO_3$, AgCl, and $AgCH_3COO$ were used as a source of silver ions. These compounds of silver were each dissolved to be a concentration of 0.1 mole/l. KSCN was dissolved in an amount of 3.0 mole/l. A solution temperature was maintained at 30° C. A pH value of the solution was adjusted to 6.4. Other conditions and preplating were the same as in Example 7.

Properties of the resulting silver platings are shown in Table 11 below.

Table 11

| No. | $AgNO_3$ (mole/l) | Tensile strength (kg/mm$^2$) | Elongation (%) | Throwing power (%) | Overall judgement |
|---|---|---|---|---|---|
| 1 | $Ag_2SO_4$ | 19.5 | 1.9 | 39 | A |
| 2 | $Ag_2O$ | 20.1 | 1.9 | 42 | A |
| 3 | $Ag_2CO_3$ | 20.8 | 2.2 | 39 | A |
| 4 | AgCl | 19.3 | 2.0 | 36 | A |
| 5 | $AgOCOCH_3$ | 18.3 | 1.8 | 35 | A |

EXAMPLE 9

In place of KI in Example 7, $3.7\times10^{-4}$–$2.25\times10^{-3}$ mole/l of $Na_2SnO_3{\cdot}3H_2O$ was used as a film improving agent. Electroplating was carried out in the same manner as in Example 7 under a cathode current density of 3A/dm$^2$ or less to obtain good silver films.

EXAMPLE 10

In place of KI in Example 7, $3\times10^{-3}$–$7.5\times10^{-1}$ mole/l of triethanol amine was used as a film improving agent. Electroplating was carried out in the same manner as in Example 7 under a cathode current density of 3 A/dm$^2$ or less to obtain good silver films.

What we claim is:

1. A method of electroplating a metallic substrate with silver, which comprises steps of subjecting the substrate to preplating under a cathode current density of 0.1 to 80 mA/dm$^2$ in an aqueous solution containing silver ions of 0.001 to 0.02 mole/l and thiocyanic ions of 0.1 to 5 moles, and electroplating the substrate preplated with silver in an aqueous solution containing silver ions 0.04 to 0.8 mole/l, thiocyanic ions of 0.5 to 10 moles/l and a film-improving agent in an amount sufficient to suppress a local growth of silver deposition under a cathode current density of 0.5 to 10 A/dm$^2$.

2. A method according to claim 1, wherein the substrate is copper.

3. A method according to claim 1, wherein the film-improving agent is at least one member selected from the group consisting of:

| | |
|---|---|
| Bromine ions ($Br^-$) | $1\times10^{-3}$ to 0.1 mole/l |
| Iodine ions ($I^-$) | $1.2\times10^{-4}$ to $1.2\times10^{-3}$ mole/l |
| Selenocyanic ions ($SeCN^-$) | $5\times10^{-4}$ to $1\times10^{-2}$ mole/l |
| Cobalt ions ($Co^{++}$) | $5\times10^{-6}$ to $5\times10^{-3}$ mole/l |
| Stannic acid ions ($SnO_3^{--}$) | $1\times10^{-4}$ to $1\times10^{-2}$ mole/l |
| Thiourea ($SC(NH_2)_2$) | $5\times10^{-5}$ to $5\times10^{-3}$ mole/l |
| Triethanol amine ($(HOCH_2CH_2)_3N$) | $1\times10^{-3}$ to 1 mole/l |
| Selennic acid ions ($SeO_4^{--}$) | $1\times10^{-3}$ to 1 mole/l<br>$5\times10^{6}$ to $5\times10^{-3}$ mole/l |

4. A method according to claim 3, wherein the bromine ions are generated from dissolved AgBr, KBr or NaBr.

5. A method according to claim 3, wherein the iodine ions are generated from dissolved KI, NaI, AgI, RbI, or CsI.

6. A method according to claim 3, wherein the selenocyanic ions are generated from dissolved KSeCN or NaSeCN.

7. A method according to claim 3, wherein the selenic acid ions are generated from dissolved $H_2SeO_4$, $Ag_2SeO_4$, $K_2SeO_4$ or $Na_2SeO_4$.

8. A method according to claim 3, wherein the cobalt ions are generated from dissolved $CoSO_4$, $CoCl_2$ or $CoSeO_4$.

9. A method according to claim 3, wherein the stannic acid ions ($SnO_3^{--}$) are generated from dissolved $Na_2SnO_3$.

10. A method according to claim 1, wherein the silver ions are generated from dissolved AgCl, AgBr, AgI, AgSCN, $Ag_2O$, $Ag_2CO_3$, $Ag_2SO_4$, $AgNO_3$, AgSCN, $Ag_2SeO_4$, or $AgCH_3COO_3$.

11. A method according to claim 1, wherein the thiocyanic ions are generated from dissolved KSCN, NaSCN, $NH_4SCN$, CsSCN, or RbSCN.

* * * * *